US008566977B2

(12) United States Patent
Davis

(10) Patent No.: US 8,566,977 B2
(45) Date of Patent: Oct. 29, 2013

(54) INFLATABLE SLING AND METHOD FOR POSITIONING A PATIENT

(75) Inventor: David T. Davis, Bethlehem, PA (US)

(73) Assignee: Woodlark Circle, Inc., Bethlehem, PA (US)

( * ) Notice: Subject to any disclaimer, the term of this patent is extended or adjusted under 35 U.S.C. 154(b) by 17 days.

(21) Appl. No.: 13/398,102

(22) Filed: Feb. 16, 2012

(65) Prior Publication Data

US 2012/0210511 A1 Aug. 23, 2012

Related U.S. Application Data

(60) Provisional application No. 61/443,901, filed on Feb. 17, 2011.

(51) Int. Cl.
*A61G 7/10* (2006.01)
*A61G 1/003* (2006.01)

(52) U.S. Cl.
USPC ..... 5/81.1 HS; 5/89.1; 5/81.1 R; 5/626

(58) Field of Classification Search
USPC ..... 5/81.1 R, 81.1 HS, 81.1 T, 89.1, 625, 5/626, 628, 703, 705, 706, 722, 723, 619
See application file for complete search history.

(56) References Cited

U.S. PATENT DOCUMENTS

| | | | | |
|---|---|---|---|---|
| 1,536,766 | A | | 5/1925 | Cammann |
| 1,961,119 | A | | 5/1934 | Ettinger |
| 2,272,778 | A | | 2/1942 | Reuter |
| 2,409,934 | A | * | 10/1946 | Haggard et al. ..... 5/627 |
| 2,688,410 | A | | 9/1954 | Nelson |
| 2,739,783 | A | | 3/1956 | Pentecost |
| 2,792,052 | A | | 5/1957 | Johannesen |
| 2,835,902 | A | | 5/1958 | Fash |
| 2,920,480 | A | | 1/1960 | Haas |
| 3,123,224 | A | | 3/1964 | Kral |
| 3,222,029 | A | | 12/1965 | Hildemann |
| 3,234,568 | A | | 2/1966 | Fischer |
| 3,310,816 | A | | 3/1967 | James et al. |
| 3,699,594 | A | | 10/1972 | Matthey-Doret |
| 3,962,737 | A | | 6/1976 | James |
| 3,998,284 | A | | 12/1976 | James |
| 4,054,960 | A | | 10/1977 | Pettit et al. |
| 4,070,721 | A | | 1/1978 | Stasko |
| 4,117,561 | A | | 10/1978 | Zamotin |
| 4,232,412 | A | | 11/1980 | Petrini |
| 4,272,856 | A | | 6/1981 | Wegener et al. |
| 4,517,690 | A | | 5/1985 | Wegener |
| 4,627,426 | A | | 12/1986 | Wegener et al. |
| 4,633,538 | A | | 1/1987 | James |
| 4,712,257 | A | | 12/1987 | James |

(Continued)

FOREIGN PATENT DOCUMENTS

| | | |
|---|---|---|
| CA | 1288379 | 9/1991 |
| GB | 2184706 | 7/1987 |
| GB | 2223477 | 4/1990 |

*Primary Examiner* — Michael Trettel
(74) *Attorney, Agent, or Firm* — Duane Morris LLP

(57) ABSTRACT

An inflatable mattress-sling having an inflatable torso support pad, a first leg extending out from a first portion of the inflatable torso support pad, and a second leg spaced from the first leg and extending out from a second portion of the inflatable torso support pad. The legs include straps attached to their inner and outer seams so as to facilitate lifting of a patient.

23 Claims, 14 Drawing Sheets

(56) References Cited

U.S. PATENT DOCUMENTS

| | | | | |
|---|---|---|---|---|
| 4,723,327 | A | 2/1988 | Smith | |
| 5,022,106 | A | 6/1991 | Richards | |
| 5,065,464 | A | 11/1991 | Blanchard et al. | |
| 5,072,840 | A | 12/1991 | Asakawa et al. | |
| 5,154,185 | A * | 10/1992 | Latimer et al. | 5/628 |
| 5,396,670 | A | 3/1995 | Firebaugh et al. | |
| 5,483,709 | A | 1/1996 | Foster et al. | |
| RE35,299 | E | 7/1996 | Weedling et al. | |
| 5,530,975 | A | 7/1996 | Firebaugh et al. | |
| 5,561,873 | A | 10/1996 | Weedling | |
| 5,579,546 | A | 12/1996 | Griskauskas | |
| 5,594,962 | A | 1/1997 | Bogdanoff | |
| 5,598,593 | A | 2/1997 | Wolfe | |
| 5,742,958 | A | 4/1998 | Solazzo | |
| 5,787,529 | A | 8/1998 | Landes | |
| 6,073,291 | A | 6/2000 | Davis | |
| 6,276,006 | B1 | 8/2001 | Hoit | |
| 6,289,534 | B1 | 9/2001 | Hakamiun et al. | |
| 6,374,435 | B1 | 4/2002 | Leininger et al. | |
| 6,415,583 | B1 | 7/2002 | Landi et al. | |
| 6,418,579 | B2 | 7/2002 | Perez et al. | |
| 6,677,026 | B1 | 1/2004 | Yates | |
| 6,684,434 | B2 | 2/2004 | Ellis et al. | |
| 6,687,935 | B2 | 2/2004 | Reeder et al. | |
| 6,760,939 | B2 | 7/2004 | Ellis et al. | |
| 6,857,143 | B2 | 2/2005 | McNulty | |
| 6,883,190 | B2 * | 4/2005 | Carbonneau et al. | 5/89.1 |
| 6,898,809 | B2 | 5/2005 | Davis | |
| 7,240,621 | B2 | 7/2007 | Chepurny et al. | |
| 7,243,382 | B2 * | 7/2007 | Weedling et al. | 5/81.1 R |
| 7,574,761 | B2 * | 8/2009 | Davis | 5/710 |
| 7,624,458 | B2 | 12/2009 | Felling | |
| 7,634,825 | B2 | 12/2009 | Chepurny et al. | |
| 7,900,299 | B2 * | 3/2011 | Weedling et al. | 5/81.1 R |
| 7,975,330 | B2 * | 7/2011 | Receveur et al. | 5/81.1 HS |
| 8,234,727 | B2 * | 8/2012 | Schreiber et al. | 5/81.1 HS |
| 2002/0166168 | A1 | 11/2002 | Weedling et al. | |
| 2003/0192118 | A1 | 10/2003 | Carbonneau et al. | |

* cited by examiner

INFLATABLE SLING AND METHOD FOR POSITIONING A PATIENT

CROSS-REFERENCE TO RELATED APPLICATIONS

This application claims priority under 35 U.S.C. §119(e) from Provisional Application Ser. No. 61/443,901, filed Feb. 17, 2011.

FIELD OF THE INVENTION

The present invention generally relates to devices for lifting or transferring patients, and more particularly to air mattresses that allow for both sliding transfers of a patient and lifting of the patient.

BACKGROUND OF THE INVENTION

Personal lift or patient lift devices have been known and used in the past for the purpose of assisting with the mobility of otherwise immobilized patients. An attendant may help physically disabled patients who may suffer from a traumatic injury, a stroke, obesity, or another form of illness that renders them unable to move about. In many cases, such patients often are also too heavy to lift or, the attendant may not have enough strength to help the patient move.

Personal lift devices that have been used in the past typically include a strap or chain hanging down from a motor assembly, which in turn may be suspended from a movable stand or from a rail carriage riding along an overhead track. An overhead track can be arranged to dangle over a chair to permit the patient to be raised, suspended, and then moved along the track to a position where they can be lowered into a bed, bathtub or the like. Typically such patient lift devices are provided with a chair or sling that is positioned under the patient, and arranged to support the patient's bulk when hoisted from the chair or the bed. Examples of such slings A (FIG. 1) may be found in the following U.S. Pat. Nos. 1,536,766; 1,961,119; 2,272,778; 2,688,410; 2,739,783; 2,792,052; 2,835,902; 2,920,480; 3,123,224; 3,222,029; 3,234,568; 3,310,816; 3,699,594; 3,962,737; 3,998,284; 4,070,721; 4,117,561; 4,232,412; 4,633,538; 4,712,257; 4,723,327; 5,022,106; 5,072,840; 5,396,670; 5,530,975; 5,579,546; 5,787,529; 6,276,006; 6,289,534; 6,883,190; 7,240,621; 7,624,458; and 7,634,825, and Foreign Patents Nos.: CA 1,288,379; U.K. 2,223,477; and U.K. 2,184,706, which patents are incorporated herein by reference.

Also, patient handling mattresses are known in the art which include at least two flexible material sheets, that together define a plenum chamber, with at least one sheet being perforated with small pinholes over at least a central surface area, and which open up directly to the interior of the plenum chamber. Such prior art mattresses are used by arranging the perforated sheet so that it faces an underlying fixed, generally planar support surface, such as a floor or table. When the mattress is charged with pressurized air, the escape of air under pressure through the pinholes acts initially to jack a load placed upon the mattress above the perforated flexible sheet, and thereby creates an air bearing of relatively small height between the underlying fixed, generally planar support surface and the perforated flexible sheet. Examples of prior art transfer mattresses may be found in U.S. Pat. Nos. 4,054,960; 4,272,856; 4,517,690; 4,627,426; 5,065,464; 5,483,709; RE35,299; 5,561,873; 5,594,962; 5,598,593; 5,742,958; 6,073,291; 6,374,435; 6,415,583; 6,418,579; 6,677,026; 6,684,434; 6,687,935; 6,760,939; 6,857,143; 6,898,809, and published patent application No. 2002/0166168, which patents and applications are incorporated herein by reference.

There is a need in the art for an inflatable transfer mattress that also provides a patient supporting sling adapted to be manipulated from a non-planar or planar position to a patient supporting position, in which a seated patient may be suspended by straps from supporting points on a patient lifting device.

SUMMARY OF THE INVENTION

The present invention provides a patient transfer device that includes a torso support pad with a first leg extending out from a portion of the torso support pad having an outer strap affixed to an outer seam and an inner strap affixed to an inner seam. The torso pad also has a second leg spaced from the first leg and extending out from the portion of the torso support pad having an outer strap affixed to an outer seam and an inner strap affixed to an inner seam.

In another embodiment, a patient transfer device is provided with a torso support pad, a first leg and a second leg. The first leg extends out from a portion of the torso support pad and includes a first strap anchor fastened to an outer seam and releasably interconnected to an outer strap. A second strap anchor is fastened to an inner seam of the first leg and releasably interconnected to an inner strap. Advantageously, the first and second strap anchors are longitudinally off-set from one another so as to provide an equal distribution of weight across the leg when a patient is positioned upon the transfer device. The second leg is spaced from the first leg and extends out from a portion of the torso support pad. The second leg includes a third strap anchor fastened to an outer seam and releasably interconnected to an outer strap and a fourth strap anchor fastened to an inner seam and releasably interconnected to an inner strap. Here again, the third and fourth strap anchors are longitudinally off-set from one another so as to provide an equal distribution of weight across the leg when a patient is positioned upon the transfer device.

In yet another embodiment of the invention, a patient transfer device is provided that includes an inflatable torso support pad having a bottom panel that defines a plurality of perforations. A first leg extends outwardly from a portion of the inflatable torso support pad that includes: (a) an outer strap affixed to an outer seam and an inner strap affixed to an inner seam and (b) a bottom panel having a plurality of perforations. The first leg is arranged in airflow communication with at least a portion of the inflatable torso pad. A second leg, that is spaced from the first leg, extends outwardly from the same portion of the inflatable torso support pad. The second leg (i) includes an outer strap affixed to an outer seam and an inner strap affixed to an inner seam, and (ii) includes a bottom panel having a plurality of perforations. The second leg is also arranged in airflow communication with at least a portion of the inflatable torso pad.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
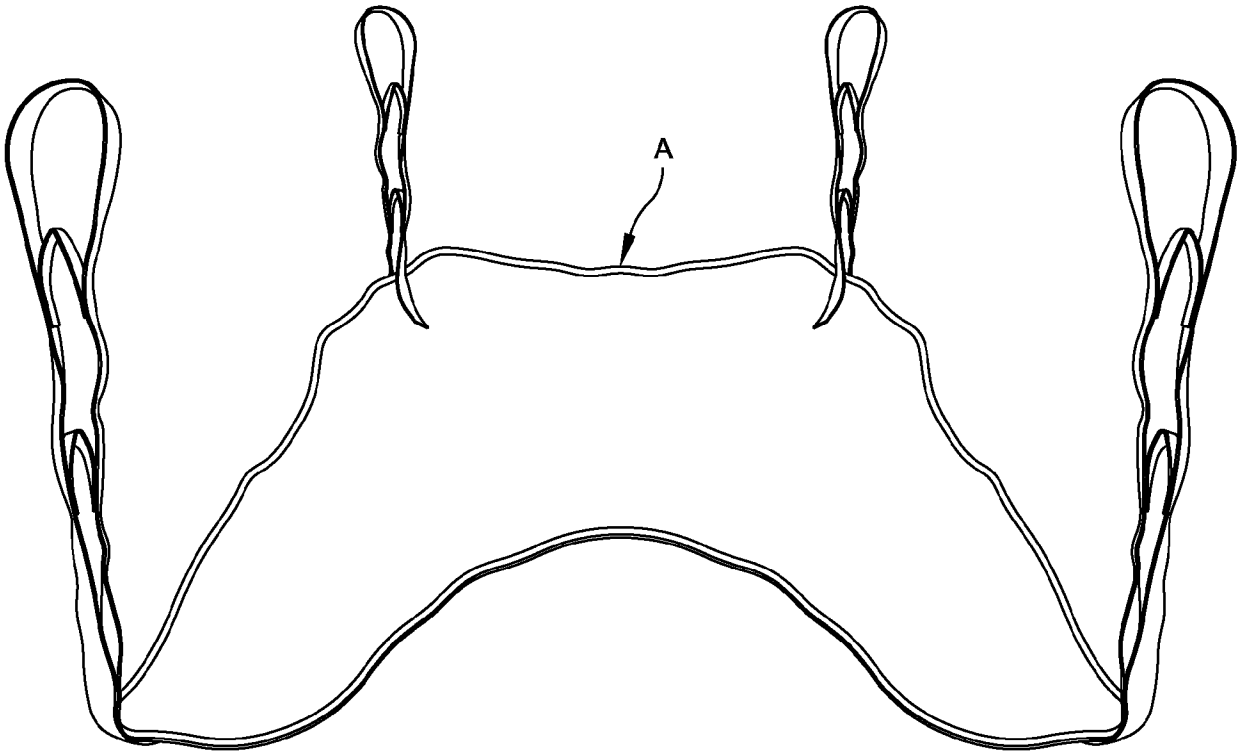
FIG. 1 (PRIOR ART)
FIG. 1 is a perspective view of a prior art patient sling.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Figure 2:
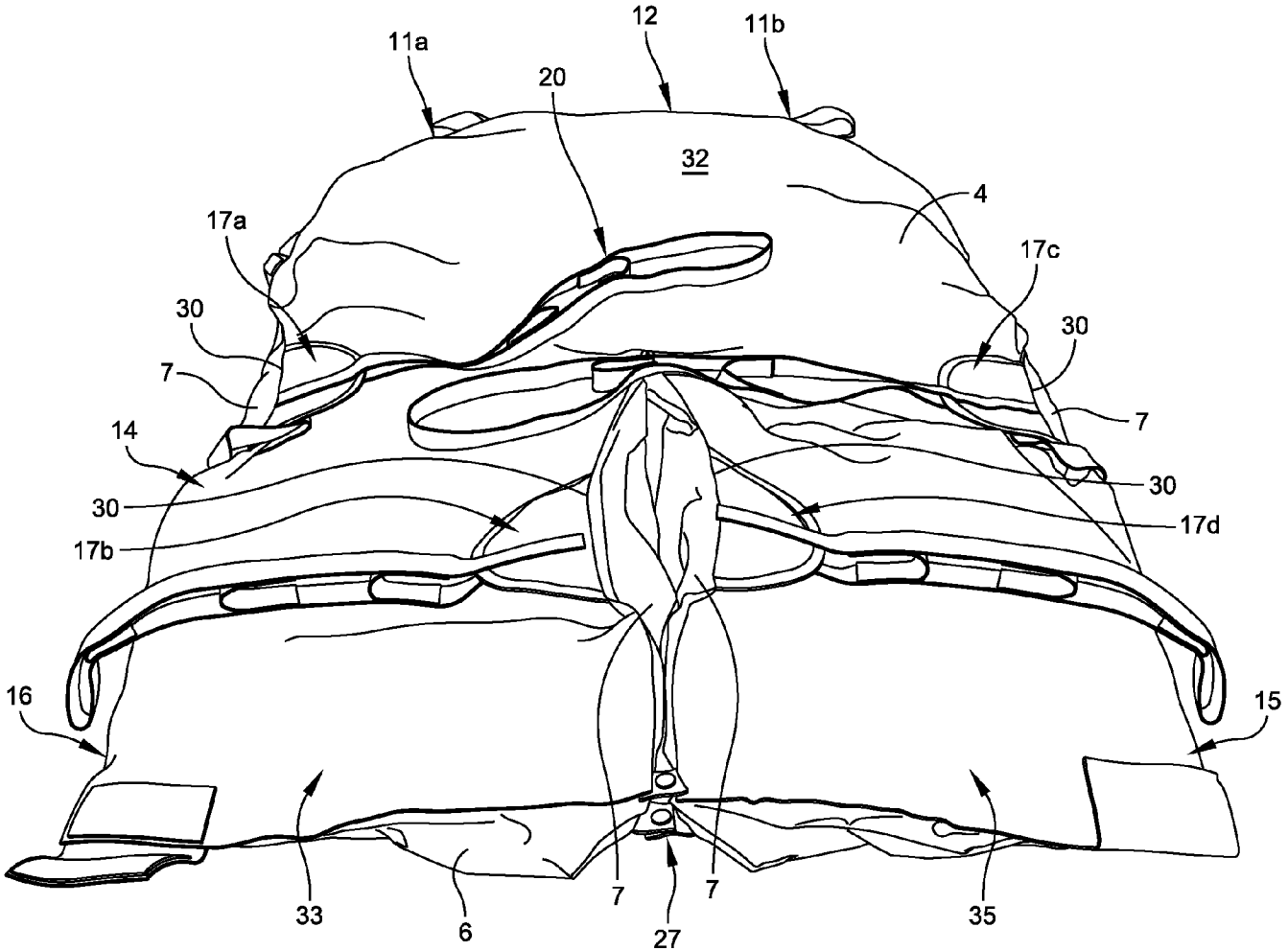
FIG. 2 is an end, perspective view of an inflatable mattress-sling.
Figure 3:
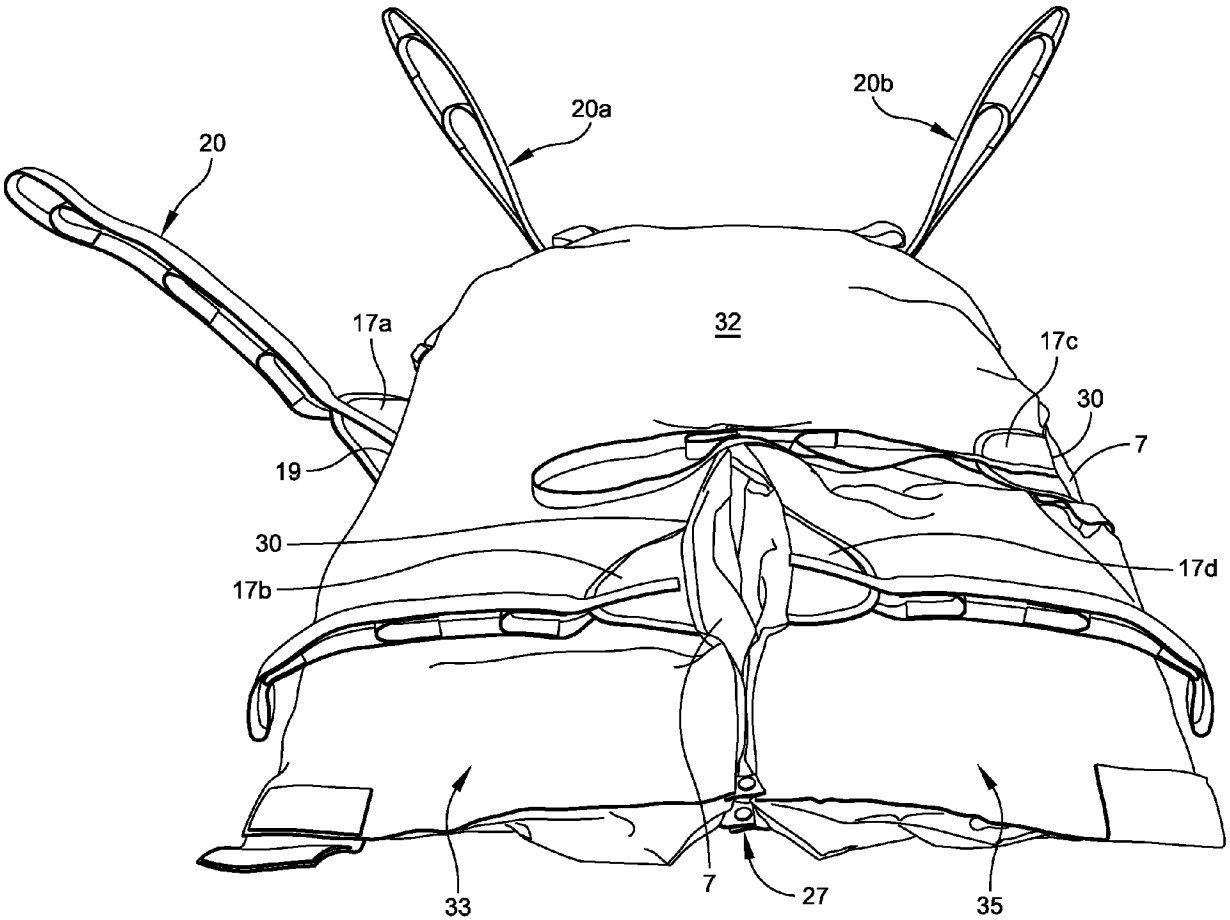
FIG. 3 is an end, perspective view of the inflatable mattress-sling shown in FIG. 2, but with some of its straps extended to show internal structures.
Figure 4:
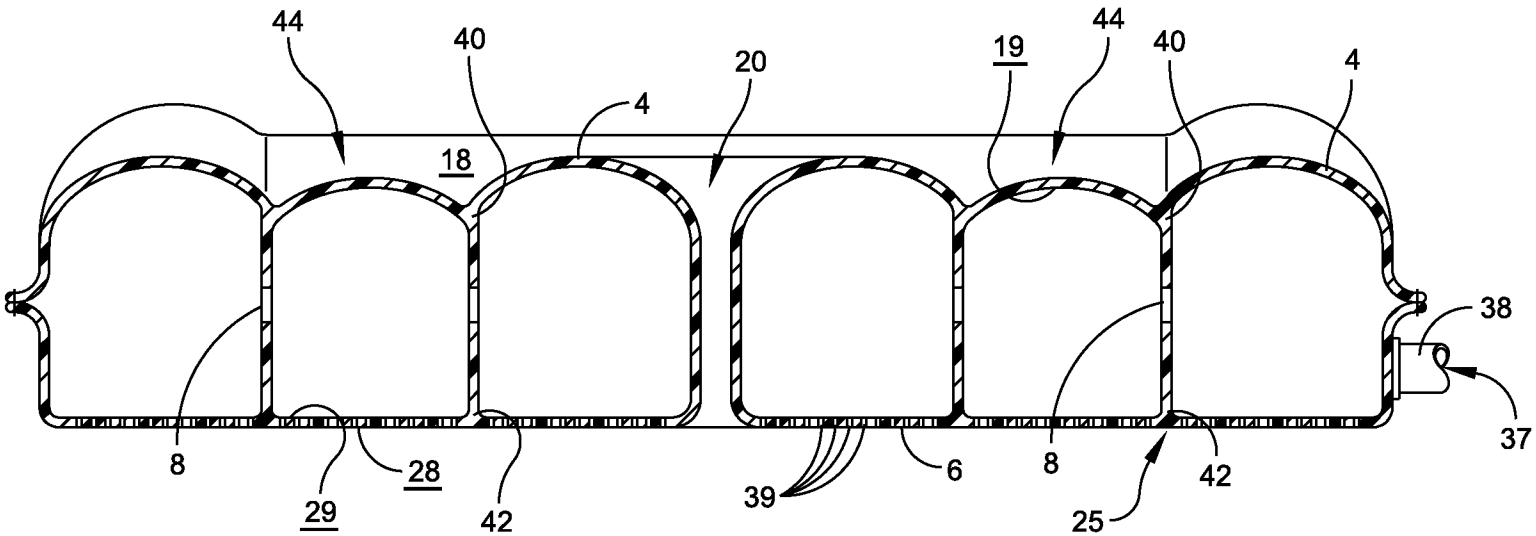
FIG. 4 is a cross-sectional view of an inflated mattress-sling.
Figure 5:
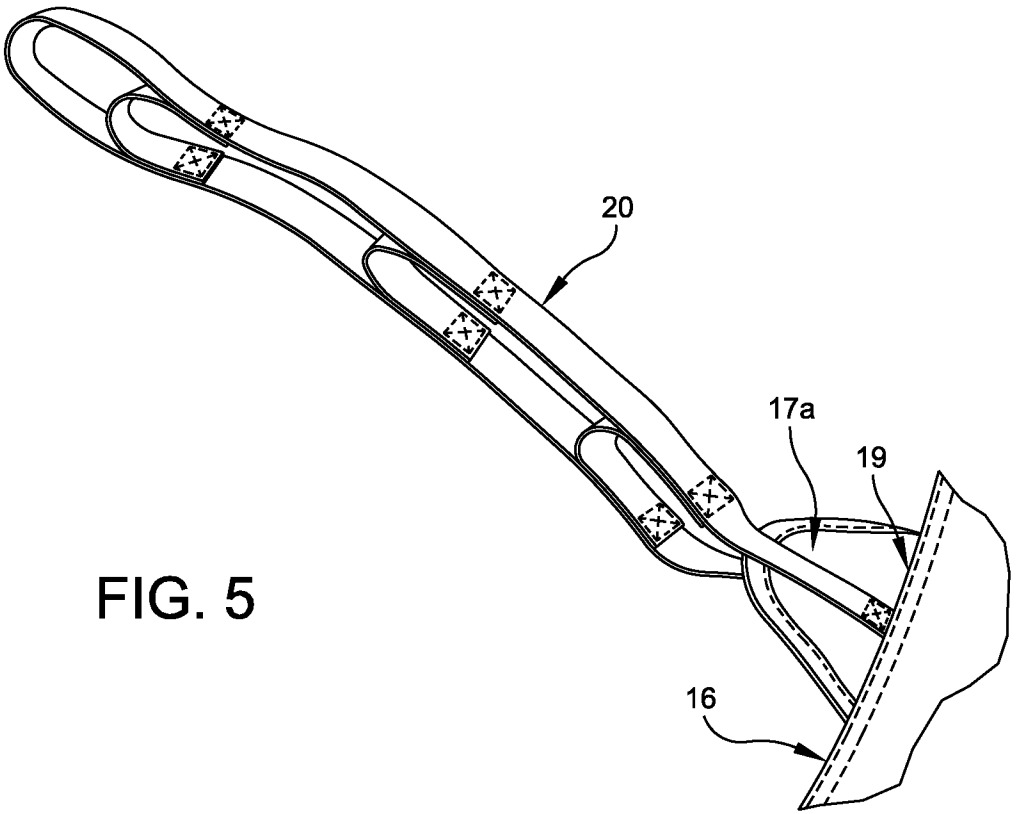
FIG. 5 perspective, broken-away view of a strap and anchor support portion of the inflatable mattress-sling shown in FIGS. 2 and 3.

Referring to FIGS. 2-4, the present invention provides an inflatable mattress-sling 2 including a top panel 4, a bottom panel 6, and a perimeter band 7. Top panel 4 comprises a head portion 12, a pair of top appendage panels 14,15, a peripheral edge 16, a first pair of strap anchors 17*a* and 17*b*, and a second pair of strap anchors 17*c* and 17*d*. Top panel 4 may be formed from a sheet of nylon scrim or twill, or from a fabric having at least one outer surface comprising a substantially permanently stainable fiber formed from a material, e.g., nylon scrim, twill, sheet of fabric acetate, acrylic, anidex, aramid, azlon, cotton, elastoester, fluorocarbon, fur, glass, lyocell, melamine, metallic, modacrylic, modal, mosacrylic, novoloid, nylon, nytril, olefin, PAN, PBI, PEEK polyetheretherketone, Pelco, PEN, PLA, PTT, polyester, polyester-polyarylate, rayon, saran, spandex, sulfar, triacetate, vinal, vinyon, and wool or blends thereof.

Figure 9:
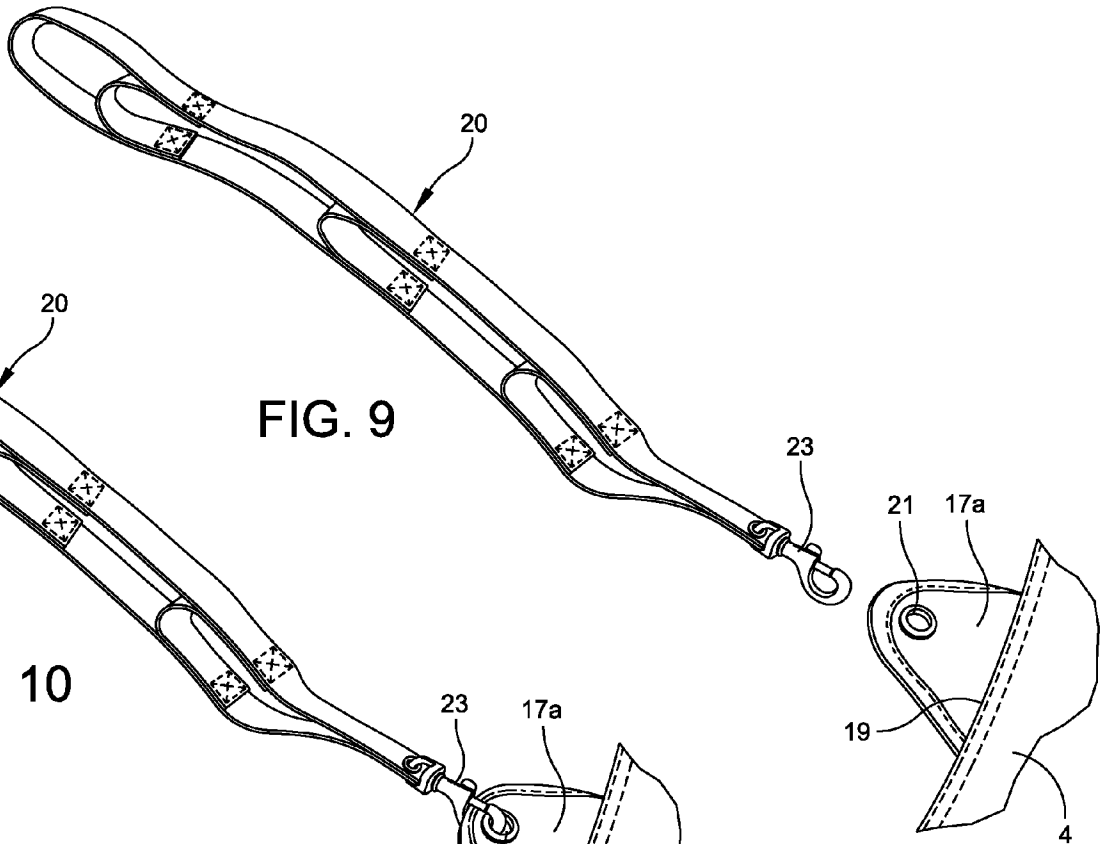
FIGS. 9 and 10 are perspective, broken-away views of a portion of one leg of the inflatable mattress-sling showing a strap anchor including an eyelet and a strap having clip that may be attached to the eyelet.
Figure 10:
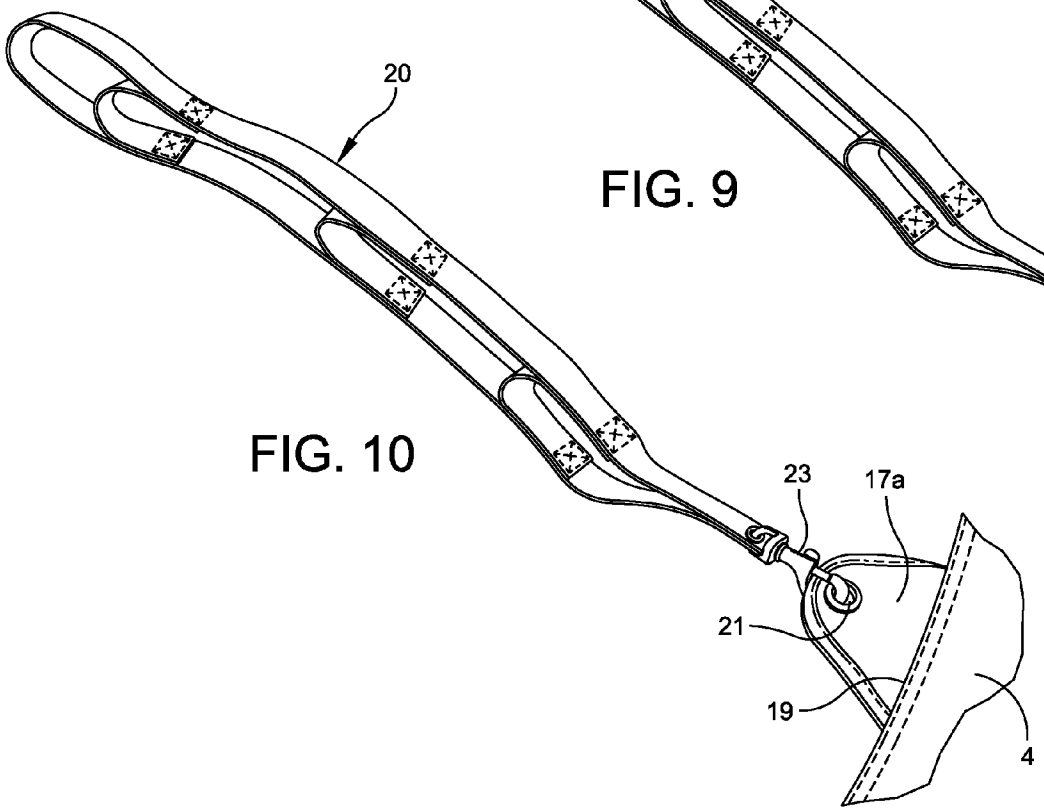
Figure 11:
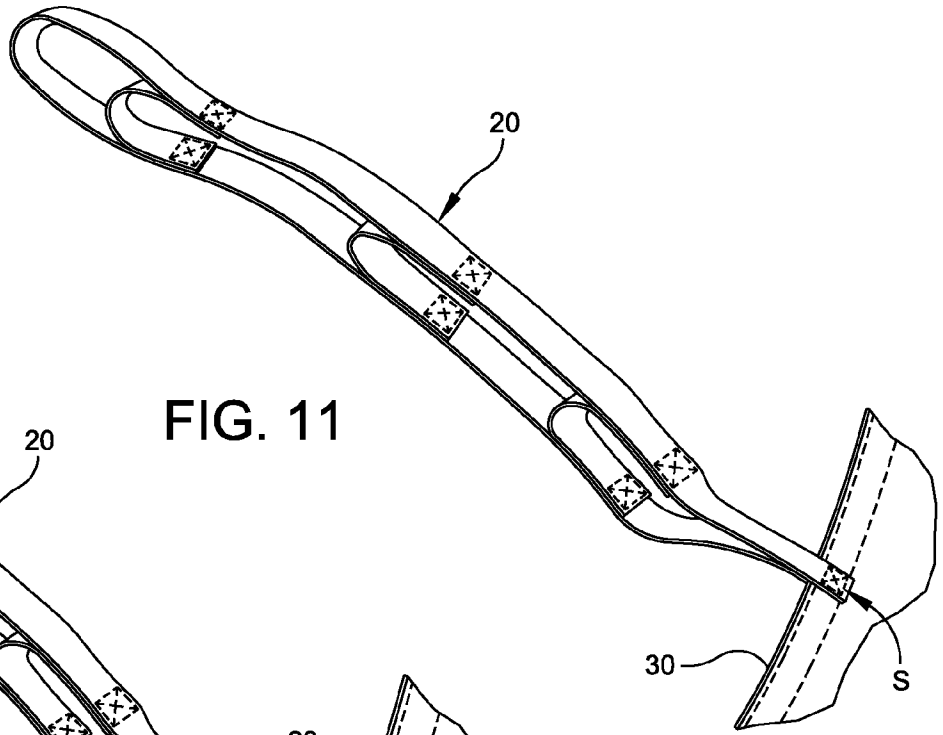
FIG. 11 is a perspective, broken-away view of a portion of one leg of the inflatable mattress-sling showing a strap affixed directly to a portion of the leg.
Figure 12:
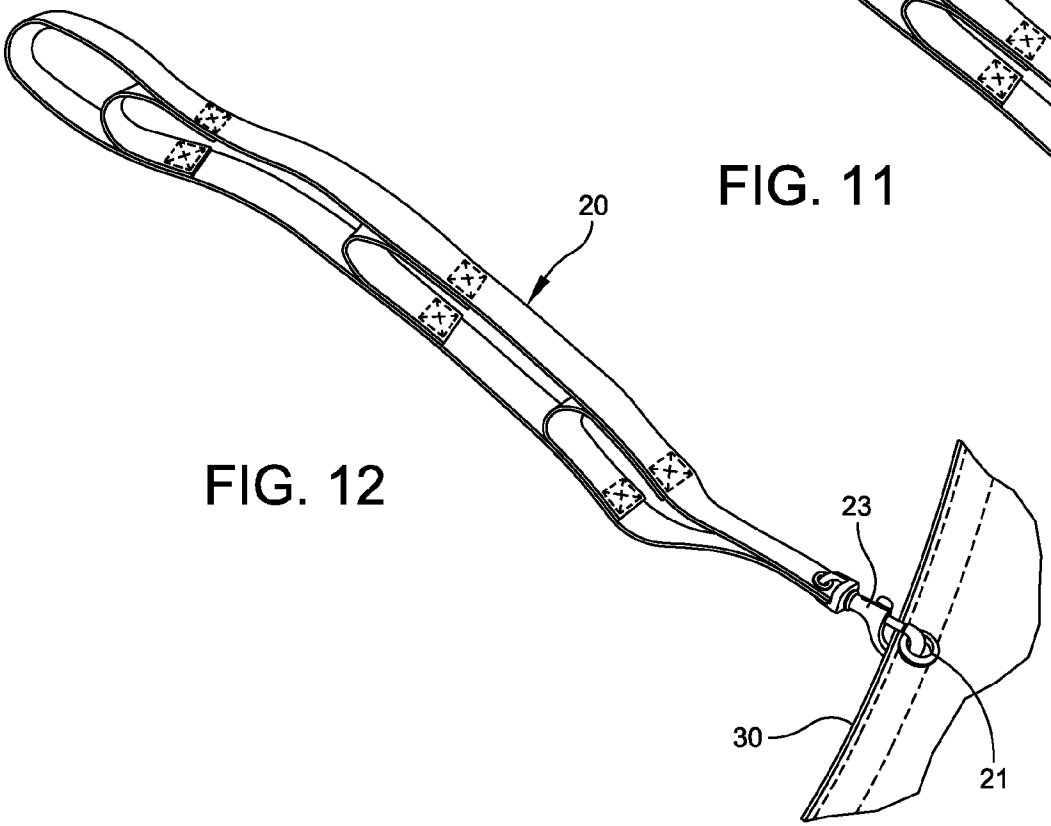
FIG. 12 is a perspective, broken-away view of a portion of one leg of the inflatable mattress-sling showing a strap having clip that may be attached to an eyelet located on a portion of the leg.
Figure 13:
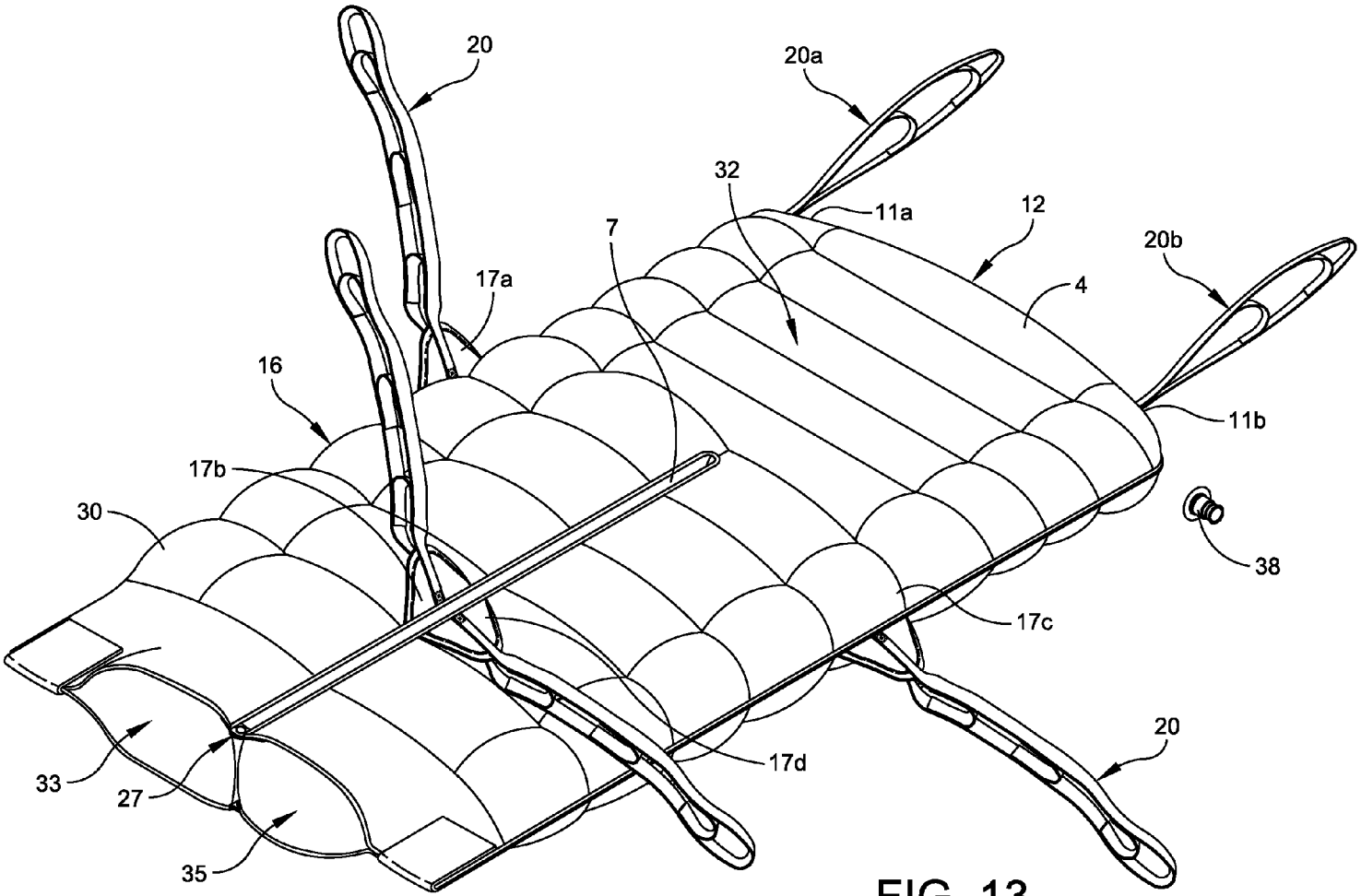
FIG. 13 is a perspective view of an inflatable mattress-sling formed in accordance with the present invention, in an inflated state.
Figure 16:
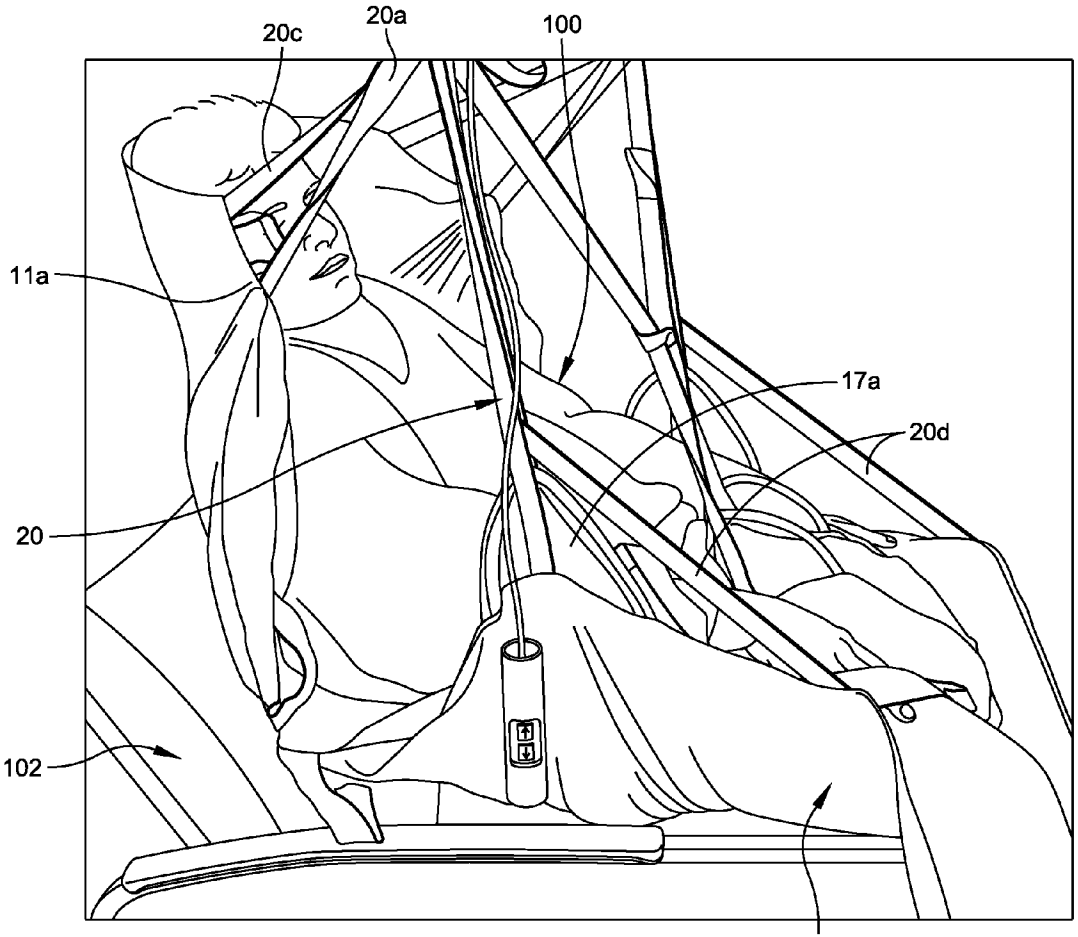
FIG. 16 is perspective view showing a patient positioned in an alternative embodiment of the inflatable mattress-sling including a head support strap.

Head portion 12 is sized and shaped so as to extend across a patient's upper torso at least from shoulder 11*a* to shoulder 11*b*, to adjacent to the base of the spine. A substantially continuous peripheral edge 16 defines the perimeter of head portion 12 and each appendage panel 14,15. Each appendage panel 14,15 is sized and shaped so as to extend longitudinally outwardly from the lower end of head portion 12, i.e., adjacent the base of the patient's spine to about the knees. Each strap anchor 17*a*, 17*b* and 17*c*, 17*d* is typically formed from a semicircular, multi-ply, fabric having a radius of about three inches or so, and a diametrically arranged edge 19. The strap anchors 17*a*, 17*b* and 17*c*, 17*d* aid in evenly distributing loads that are placed upon them across the top or bottom panels of the mattress-sling during lifting, thereby reducing the likelihood of the seam defining peripheral edge 16 from rupture. In some embodiments structural reinforcements are placed between the plys of each strap anchor to increase their stiffness. In other embodiments, however, straps 20 may be securely fastened directly to corresponding, complementary structures formed within or adjacent to the seam forming peripheral edge 16, e.g., releasably interconnected to a receptacle such as corresponding eyelet 21 or loop 22 with a catch or clip 23 (FIGS. 9-10, and 12). In another embodiment, strap 20 may be clipped onto a leg of the mattress sling through an eyelet 21 formed in top edge 30 of any one of the legs or sewn or sealed to edge 30 at a location S along its length (FIG. 11). In a further embodiment, a head support strap 20*c* extends from a central portion of each of straps 20*a* and 20*b* to a portion of peripheral edge 16 adjacent to the upper regions of head portion 12 so as to form a supporting cradle around a patient's head during lifting or lowering. In other embodiments, a knee support strap 20*d* extends from a central portion of each of straps 20 to a portion of peripheral edge 16 adjacent to a central portion of each leg so as to form a supporting cradle around a patient's legs during lifting or lowering. (FIG. 16).

Figure 6:
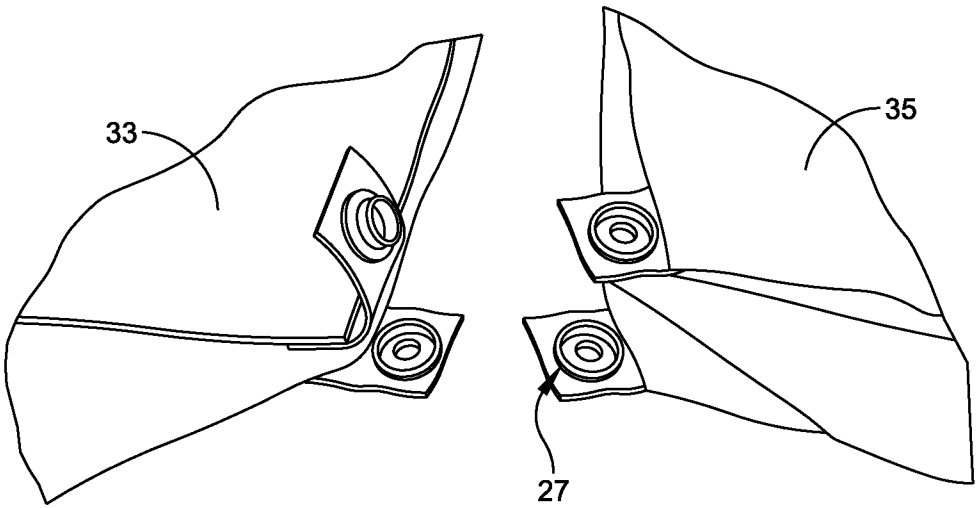
FIG. 6 is a perspective, broken-away view of a portion of the legs of the inflatable mattress-sling showing a closure device.
Figure 14:
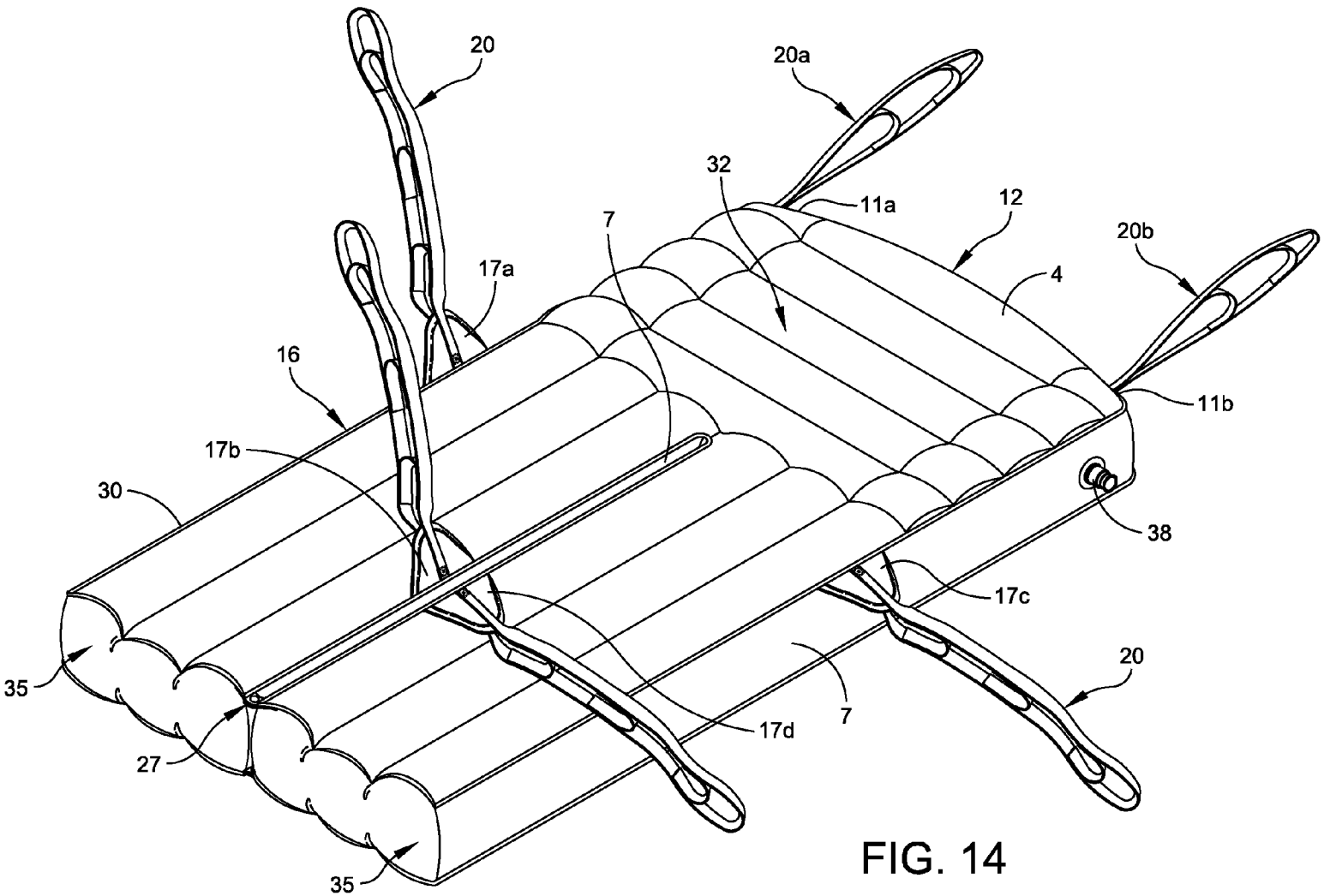
FIG. 14 is a perspective view of an alternative embodiment of inflatable mattress-sling formed in accordance with the present invention, in an inflated state.
Figure 15:
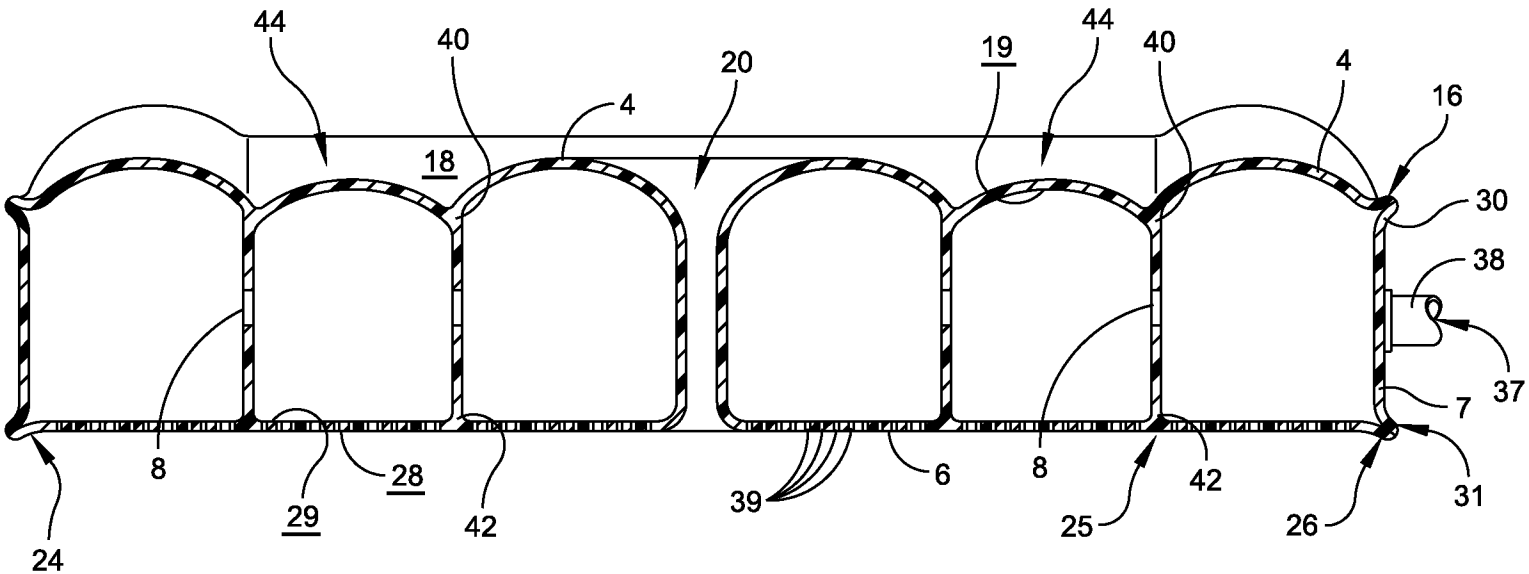
FIG. 15 is a cross-sectional view of the inflated mattress-sling shown in FIG. 15.

Referring to FIG. 4, bottom panel 6 is substantially similar in peripheral profile to top panel 4, and comprises a head portion, a pair of bottom appendage panels 24,25, and a peripheral edge 26. Bottom panel 6 may be a common (single) structure within inflatable mattress-sling 2 that is often formed from a sheet of nylon scrim or twill, or from a fabric having at least one outer surface comprising a substantially permanently stainable fiber formed from a material, e.g., nylon scrim, twill, sheet of fabric acetate, acrylic, anidex, aramid, azlon, cotton, elastoester, fluorocarbon, fur, glass, lyocell, melamine, metallic, modacrylic, modal, mosacrylic, novoloid, nylon, nytril, olefin, PAN, PBI, PEEK polyetheretherketone, Pelco, PEN, PLA, PTT, polyester, polyester-polyarylate, rayon, saran, spandex, sulfar, triacetate, vinal, vinyon, and wool or blends thereof. Perimeter band 7 often comprises an elongate substantially rectangular strip of nylon scrim or the like, having a top edge 30 and a bottom edge 31 (FIGS. 14 and 15). In other embodiments of the invention (FIGS. 2-4) a perimeter band may be omitted without deviating from the invention. The head portion of bottom 6 is also sized and shaped so as to extend across a patient's upper torso at least from shoulder to shoulder and from the base of the spine to the top of the head. Each appendage panel 24,25 is sized and shaped so as to extend from the base of the patient's spine to about the knee. Peripheral edge 26 defines the perimeter of the head portion of bottom 6, and each appendage panel 24,25. A pair of snap closures 27 are often located at the inner corners of legs 33 and 35 so as to facilitate closure of the legs of mattress-sling 2 during lifting (FIGS. 2, 3, and 6).

In preferred embodiments of the invention, top panel 4 and bottom panel 6 are substantially the same in size and peripheral outline so that top edge 30 and bottom edge 31 of perimeter band 7 may be sealingly fastened to peripheral edges 16 and 26 of top and bottom panels 4, 6, respectively. In this way, a preferred inflatable mattress-sling 2 comprises a torso support pad 32 formed from the joining of the head portions of top 4 and bottom 6, a first leg 33 formed from the joining of top appendage panel 14 and bottom appendage panel 24 and a second leg 35 formed from the joining of top appendage panel 15 and bottom appendage panel 25. In one embodiment, strap anchor 17*a* is fastened to leg 33 between top edge 30 of perimeter band 7 and peripheral edge 16 of top panels 4 at a location on the outer peripheral side of leg 33, while strap anchor 17*b* is fastened to leg 33 between top edge 30 of perimeter band 7 and peripheral edge 16 of top panels 4 at a location on the inner peripheral side of leg 33. In addition, strap anchor 17*c* is fastened to second leg 35 between top edge 30 of perimeter band 7 and peripheral edge 16 of top panel 4 a location on the outer peripheral side of leg 35 while strap anchor 17*d* is fastened to leg 35 between top edge 30 of perimeter band 7 and peripheral edge 16 of top panels 4 at a location on the inner peripheral side of leg 35. Advantageously, the relative locations of strap anchors 17*a* and 17*b* are often longitudinally spaced apart along leg 33, and strap anchors 17*c* and 17*d* are also often longitudinally spaced apart along leg 35. In other embodiments of the invention each strap anchor or, a free end of each strap 20, may be sealingly fastened between peripheral edges 16 and 26 of top and bottom panels 4, 6, respectively (FIGS. 2-4).

An inlet opening 37 is formed in a portion of perimeter band 7, and may be a closable opening that sealingly accepts an air supply hose 38. Inlet opening 37 is sized and shaped so that air supply hose 38 may be inserted, with the inlet being thereafter snapped shut or otherwise closed to hold air supply hose 38 in place while inflatable mattress-sling 2 is being inflated. Inlet opening 37 may also include a valve (not shown) that is biased to be normally closed to prevent air from exiting through the inlet, and opened when air supply hose 38 is inserted into inlet opening 37. Other arrangements known to those skilled in the art may be used to inflate inflatable mattress-sling 2.

In one alternative embodiment of the invention, bottom panel 6 includes a plurality of tiny holes 39 (FIGS. 4 and 15) that are defined through its thickness to allow air, that is supplied by a high-pressure air supply to inflatable mattress-sling 2, via air supply hose 38, to escape in a controlled manner so as to allow inflatable mattress-sling 2 to be used as a transfer mattress. The air supplied to a lateral transfer-capable embodiment of inflatable mattress-sling 2 escapes through plurality of holes 39, providing a weight-bearing cushion of air that facilitates the sliding of inflatable mattress-sling 2 along a surface, as well as, from one surface to another.

Still referring to FIGS. 4 and 15, plurality of baffle-panels 8 each comprise substantially rectangular sheets of nylon scrim or the like, and include a top edge 40 and a bottom edge 42. Baffle-panels 8 may have differing or varying widths, depending upon their position within inflatable mattress-sling 2. Each top edge 40 may be fastened longitudinally to a portion of the inner surface of top panel 4, and each bottom edge 42 may be fastened longitudinally (FIGS. 4 and 15) to a portion of inner surface 29 of bottom panel 6.

An inflatable mattress-sling 2 is assembled according to the present invention in the following manner. Bottom panel 6 is laid out on a suitable support surface so that baffle-panels 8 may be longitudinally arranged in the center section of inner surface 29 in the head portion, and along each appendage panel 24,25. Once in this position, bottom edge 42 of each baffle-panel 8 is fixedly fastened to inner surface 29 of bottom panel 6. Baffle-panels 8 may be heat sealed along the interface between bottom edge 42 and inner surface 29 of bottom panel 6 or sewn in a conventional manner. Heat sealing may be done with the application of heat or ultra sonic energy at the edge interface. In this way, a re-solidified interface structure is formed between bottom edge 42 and inner surface 29 so as to improve the bond and its resistance to rupture under normal loading.

Once plurality of baffle-panels 8 are fastened to inner surface 29 of bottom panel 6, top panel 4 is arranged in overlying confronting relation with bottom panel 6 so that head portion 12 of top panel 4 is confronting the corresponding head portion of bottom panel 6 and appendage panels 14,15 of top panel 4 are in confronting relation to appendage panels 24,25 of bottom panel 6. Once in this position, each top edge 40 of each baffle-panel 8 is fixedly fastened to inner surface 19 of top panel 4. One or more perimeter bands 7 are then positioned between peripheral edge 16 of top panel 4 and peripheral edge 26 of bottom panel 6, and then heat sealed along their interface or sewn in a conventional manner. In some embodiments, perimeter bands may only be located on the interior of legs 33 and 35, extending to a portion of the distal ends of the legs (FIGS. 2-4). Here again, heat sealing may be done with the application of heat or ultra sonic energy at the interface between peripheral edges 16,26. In this way, a re-solidified interface structure is formed so as to improve the bond and its resistance to rupture under normal loading.

Advantageously, strap anchors 17*a* and 17*c* are first located at the interface between peripheral edges 16 and 26 on the outer sides of legs 33 and 35, respectively, and adjacent to crotch 20, such that each diametric edge 19 of each strap anchor is positioned between a portion of perimeter band 7 and top panel 4. In this way, the remainder of strap anchors 17*a* and 17*c* project outwardly from the seam that is formed by the sealing process. In like manner, strap anchors 17*b* and 17*d* are first located at the interface between peripheral edges 16 and 26, but on the inner sides of legs 33 and 35. In some preferred embodiments, strap anchors 17*b* and 17*d* are located in longitudinally spaced apart relation to strap anchors 17*a* and 17*c*. Each diametric edge 19 of each strap anchor is positioned between a portion of perimeter band 7 and top panel 4. In this way, the remainder of strap anchors 17*b* and 17*d* project outwardly from the seam that is formed by the sealing process. In other embodiments of the invention each strap anchor or, a free end of each strap 20, may be sealingly fastened between peripheral edges 16 and 26 of top and bottom panels 4, 6, respectively (FIGS. 2-4).

Figure 7:
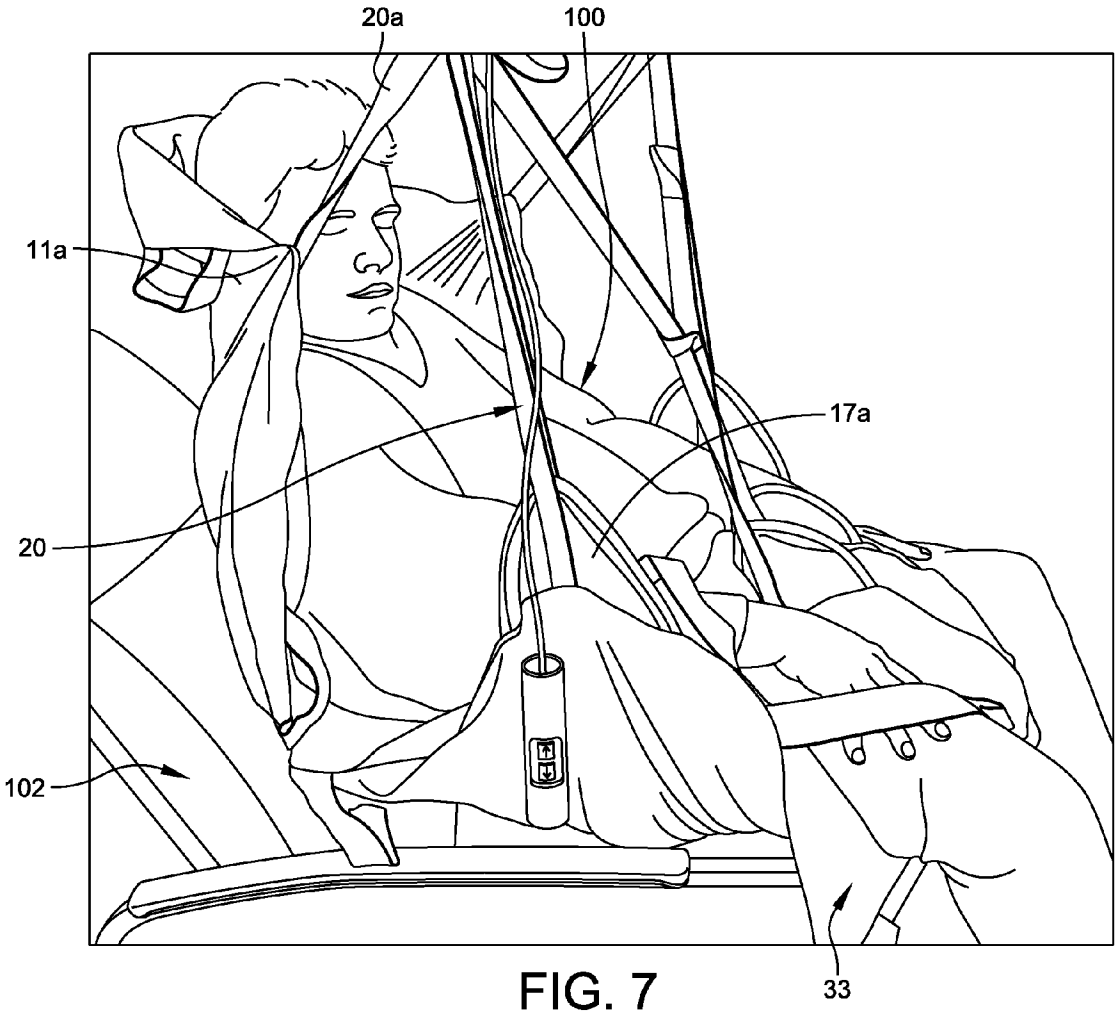
FIG. 7 is perspective view showing a patient positioned in inflatable mattress-sling.
Figure 8:
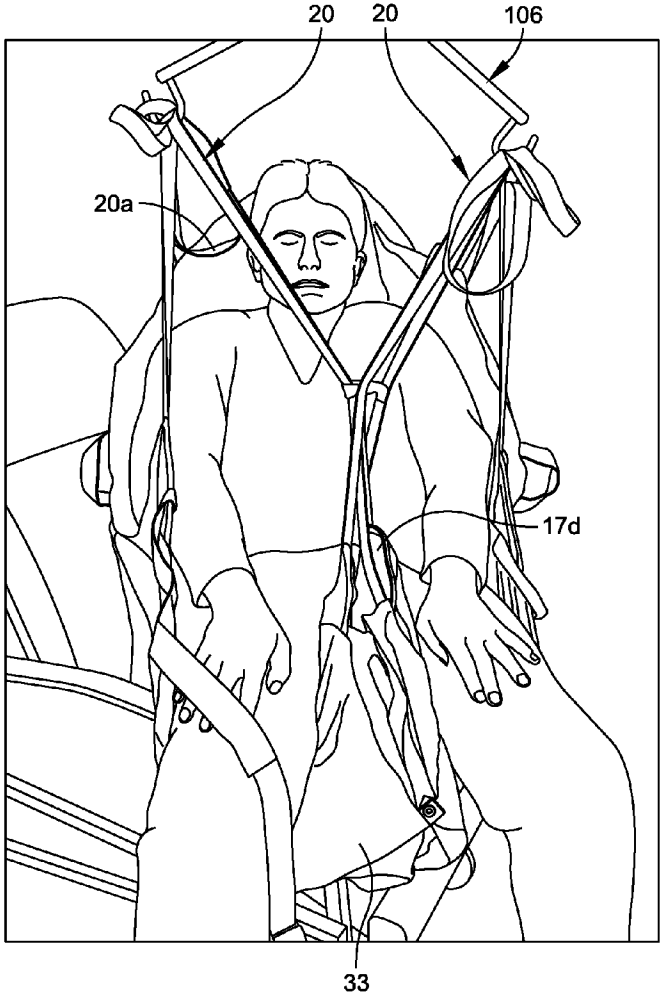
FIG. 8 is front perspective view showing a patient positioned in inflatable mattress-sling.

Referring to FIGS. 7 and 8, inflatable mattress-sling 2 may be used to allow for easy positioning and movement of patients as follows. Straps 20*a* and 20*b* fasten to shoulders 11*a* and 11*b* are similarly attached to derrick 106 so as to secure the upper portion of torso pad 32 against the back of patient 100. Once in this position, derrick 106 may be moved upwardly, thereby causing mattress-sling 2 to cradle patient 100 and support patient 100's weight as it is lifted from chair 102. Advantageously, the off-set positioning of the anchor straps significantly diminishes creasing or folding of the leg portions of mattress-sling 2, thereby removing possible pain causing stress concentrations during lifting. In many embodiments, strap hangers 17*a*, 17*b* and 17*c*, 17*d* are offset longitudinally from one another along each of legs 33 and 35. Unlike the prior art, this relative location of the strap anchors provides for an equal distribution of weight across panel 4 of legs 33 and 35, once again reducing creasing or folding of the fabric and subsequent pain or injury to the patient.

Once patient 100 cradled in mattress-sling 2 is moved via derrick 106 from chair 102 onto a suitable surface, e.g., a bed, the foregoing procedure may be reversed so as to lower patient 100 onto the bed's surface. Once in this position, an air hose 38 may be connected to nozzle 37 so as to introduce air under pressure into the interior of mattress-sling 2 so as to inflate mattress-sling 2, thereby forming a transfer mattress for movement laterally of the patient on the bed or from the bed to a similar height flat surface.

It is to be understood that the present invention is by no means limited only to the particular constructions herein disclosed and shown in the drawings, but also comprises any modifications or equivalents within the scope of the claims.

What is claimed is:

1. A patient transfer device comprising;

a torso support pad;

a first leg extending out from a portion of said torso support pad having an outer strap attached to an outer seam and an inner strap attached to an inner seam; and a second leg spaced from said first leg and extending out from said portion of said torso support pad having an outer strap attached to an outer seam and an inner strap attached to an inner seam, wherein each of said outer straps and said inner straps are releasably interconnected to a corresponding eyelet formed adjacent to each said seam.

2. A patient transfer device according to claim 1 wherein said first leg includes at least two strap anchors, one located between said outer strap and said outer seam and the other one of said strap anchors located between said inner strap and said inner seam.

3. A patient transfer device according to claim 1 wherein said second leg includes at least two strap anchors, one located between said outer strap and said outer seam and the other one of said strap anchors located between said inner strap and said inner seam.

4. A patient transfer device according to claim 2 or 3 wherein said at least two strap anchors are longitudinally spaced apart from one another.

5. A patient transfer device according to claim 4 wherein a portion of each strap anchor is fastened within a seam.

6. A patient transfer device according to claim 5 wherein each of said strap anchors are formed from a semicircular fabric having a diametrically arranged edge such that said edge is fastened within said seam.

7. A patient transfer device according to claim 5 wherein each of said strap anchors are formed from a semicircular fabric having structural reinforcements to increase stiffness.

8. A patient transfer device comprising;

a torso support pad;

a first leg extending out from a portion of said torso support pad having an outer strap releasably fastened to an outer seam and an inner strap releasably fastened to an inner seam wherein said outer and inner straps are longitudinally spaced apart from one another;

a second leg spaced from said first leg and extending out from said portion of said torso support pad having an outer strap releasably fastened to an outer seam and an inner strap releasably fastened to an inner seam wherein said outer and inner straps of said second leg are longitudinally spaced apart from one another, wherein each of said outer straps and said inner straps are releasably fastened to a corresponding eyelet formed adjacent to each said seam.

9. A patient transfer device comprising;

an inflatable torso support pad including a bottom panel comprising a plurality of perforations;

a first leg extending outwardly from a portion of said inflatable torso support pad (a) including an outer strap attached to an outer seam and an inner strap attached to an inner seam, (b) including a bottom panel having a plurality of perforations, and (c) being arranged in airflow communication with at least a portion of said inflatable torso pad;

a second leg spaced from said first leg and extending outwardly from said portion of said inflatable torso support pad, said second leg (i) including an outer strap attached to an outer seam and an inner strap attached to an inner seam, (ii) including a bottom panel having a plurality of perforations, and (iii) being arranged in airflow communication with at least a portion of said inflatable torso pad.

10. A patient transfer device according to claim 9 wherein said outer and inner straps are longitudinally spaced apart from one another on each of said first leg and said second leg.

11. A patient transfer device according to claim 1 or 9 wherein said torso support pad defines a head support portion and a support strap is fastened to a portion of a first outer strap and said head support portion and another support strap is fastened to a portion of a second outer strap and said head support portion.

12. A patient transfer device according to claim 9 wherein said first leg includes at least two strap anchors, one located between said outer strap and said outer seam and the other one of said strap anchors located between said inner strap and said inner seam.

13. A patient transfer device according to claim 9 wherein said second leg includes at least two strap anchors, one located between said outer strap and said outer seam and the other one of said strap anchors located between said inner strap and said inner seam.

14. A patient transfer device according to claim 12 or 13 wherein said at least two strap anchors are longitudinally spaced apart from one another.

15. A patient transfer device comprising;

a torso support pad;

a first leg extending out from a portion of said torso support pad having a first strap releasably coupled to a fastener adjacent to an outer seam; and a second strap releasably coupled to a fastener adjacent to an inner seam, wherein said first and second straps are longitudinally off-set from one another so as to provide an equal distribution of weight across said leg when a patient is positioned upon said transfer device;

a second leg spaced from said first leg and extending out from said portion of said torso support pad having a third strap releasably coupled to a fastener adjacent to an outer seam and a fourth strap releasably coupled to a fastener adjacent to an inner seam, wherein said third and fourth straps are longitudinally off-set from one another so as to provide an equal distribution of weight across said leg when a patient is positioned upon said transfer device.

16. A patient transfer device according to claim 15 wherein said torso support pad defines a head support portion and a support strap is fastened to a portion of said first strap and said head support portion and another support strap is fastened to a portion of said second strap and said head support portion.

17. A patient transfer device according to claim 16 wherein said first leg has a support strap fastened to a portion of said third strap and said second leg has a support strap fastened to a portion of said fourth strap.

18. A patient transfer device according to claim 17 wherein said peripheral seam includes structural reinforcements to increase stiffness.

19. A patient transfer device according to claim 9 wherein each of said outer straps and said inner straps are releasably interconnected to a corresponding eyelet adjacent to each of said peripheral seams.

20. A patient transfer device according to claim 9 wherein said torso support pad, said first leg and said second leg comprise a common perforated bottom panel.

21. An inflatable patient transfer device comprising:

a torso support pad including a top panel having a head portion, a first appendage portion, a second appendage portion, and a peripheral edge; a bottom panel having a head portion, a first appendage portion, a second appendage portion, a peripheral edge, and a plurality of perforations; and a perimeter band having a top edge and a bottom edge so that said peripheral edge of an interior portion of said top panel is sealingly fastened to said top edge of said perimeter band and said peripheral edge of an interior portion of said bottom panel is sealingly fastened to said bottom edge of said perimeter band, and further including an air inlet port positioned in a portion of said top panel wherein said bottom panel defines a plurality of perforations so as to form a transfer-capable inflatable mattress;

a first leg formed by said first appendage portion of said top and said bottom panels and that extends out from a portion of said torso support pad, said first leg having an outer strap releasably interconnected to an outer seam; and an inner strap releasably interconnected to an inner seam wherein said outer and inner strap of said first leg are longitudinally off-set from one another so as to provide an equal distribution of weight across said leg when a patient is positioned upon said transfer device;

a second leg formed by said first appendage portion of said top and said bottom panels and that is spaced from said first leg and extends out from said portion of said torso support pad, said second leg having an outer strap releasably interconnected to an outer seam; and an inner strap releasably interconnected to an inner seam, wherein said outer strap and said inner strap of said second leg are longitudinally off-set from one another so as to provide an equal distribution of weight across said leg when a patient is positioned upon said transfer device.

22. A patient transfer device according to claim 21 wherein a portion of each strap is releasably fastened adjacent to a seam.

23. A patient transfer device according to claim 21 wherein each of said outer straps and said inner straps are releasably interconnected to a corresponding eyelet formed thin each of said strap anchors.

* * * * *